US008325565B2

(12) United States Patent
Hiranuma et al.

(10) Patent No.: US 8,325,565 B2
(45) Date of Patent: Dec. 4, 2012

(54) TIMEPIECE

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 88 days.

(21) Appl. No.: 12/932,443

(22) Filed: Feb. 24, 2011

(65) Prior Publication Data

US 2011/0228645 A1 Sep. 22, 2011

(30) Foreign Application Priority Data

Mar. 17, 2010 (JP) ..... 2010-061637

(51) Int. Cl.
*G04B 1/00* (2006.01)
*G04B 19/06* (2006.01)
*G04B 37/00* (2006.01)

(52) U.S. Cl. ..... 368/236; 368/205; 368/299

(58) Field of Classification Search ..... 368/205, 368/228, 232, 236, 297, 299, 300
See application file for complete search history.

(56) References Cited

U.S. PATENT DOCUMENTS 1,886,166 A * 11/1932 Colomb ..... 368/236
3,668,865 A * 6/1972 Hirabayashi ..... 368/236
4,184,317 A * 1/1980 Kanda et al. ..... 368/300
4,207,735 A * 6/1980 Ishigaki et al. ..... 368/300
4,924,452 A * 5/1990 Meyrat et al. ..... 368/236
5,966,344 A * 10/1999 Umemoto et al. ..... 368/88
6,456,569 B1 * 9/2002 Stauffer ..... 368/236
6,575,619 B1 * 6/2003 Stauffer ..... 368/299

OTHER PUBLICATIONS

Patent Abstracts of Japan, publication No. 2001-194470, publication date Jul. 19, 2001.

* cited by examiner

*Primary Examiner* — Vit W Miska
(74) *Attorney, Agent, or Firm* — Adams & Wilks

(57) ABSTRACT

A timepiece is equipped with a movement (module), a solar cell panel, a ring member, and a dial (timepiece display plate). The panel is fixed to the module. The ring member is fixed to the peripheral portion of the movement. The ring member has, at a plurality of positions thereof, recesses, and a pair of engagement protrusions protruding upwardly from the bottom of each recess. The recesses are respectively open in an upper surface and the outer peripheral surface of the ring member. The pair of engagement protrusions form a gap G between them, and are capable of elastic deformation. A proximal portion of each engagement protrusion is situated below the upper surface of the ring member. The dial has cutouts at a plurality of positions of its peripheral portion. Each of these cutouts is engaged with each pair of engagement protrusions to cover the panel, and the dial is mounted to the ring member such that the peripheral portions of the cutouts cover the recesses.

9 Claims, 9 Drawing Sheets

TIMEPIECE

BACKGROUND OF INVENTION

1. Field of the Invention

The present invention relates to a timepiece such as a wristwatch in which a panel for power generation or light emission is fixed to a module for displaying time, etc. and in which this panel is covered with a timepiece display plate and, in particular, to a timepiece improved in terms of the construction for mounting the timepiece display plate.

2. Description of the Prior Art

As a prior-art technique, there is known a timepiece in which a solar cell or an electroluminescence and a timepiece display plate are fixed to each other (See, for example, Japanese Patent No. 4398555 (paragraphs 0016 through 0044, FIGS. 1 through 6)).

In this prior-art technique, an auxiliary ring consisting of a resin molding has a pair of columnar protrusions at a plurality of positions on the upper surface of the outer peripheral portion thereof, and a protrusion on the lower surface thereof. The protrusion of this auxiliary ring is engaged with a module to fix the auxiliary ring to this module. At the same time, the timepiece display plate is formed as a thin plate of a transparent resin molding of acryl, polycarbonate or the like, and a plurality of cutouts are provided in the peripheral portion thereof. And, by engaging these cutouts with the columnar protrusions of the module, the timepiece display plate is fixed in position.

More specifically, the pair of columnar protrusions have a gap between them, and are formed so as to be capable of elastic deformation toward the gap. The cutouts of the timepiece display plate are engaged with these, with the pair of columnar protrusions arranged on the inner side thereof being elastically deformed. As a result, it is possible to fix the timepiece display plate in a state in which it is prevented from lateral shift or rotation.

SUMMARY OF THE INVENTION

In a timepiece according to the prior-art technique, to detach the timepiece display plate from the module, it is common practice to pry off the timepiece display plate by using a tool such as tweezers. It is effective and desirable to perform this prying-off operation at a position in the vicinity of the cutouts engaged with the columnar protrusions.

In the prior-art technique, however, the peripheral portion of the timepiece display plate, inclusive of the peripheral portion of the cutouts, is provided so as to be in contact with the upper surface of the auxiliary ring. As a result, it is rather difficult to insert, at the position in the vicinity of the cutouts, a tool such as tweezers into the gap between the peripheral portion of the timepiece display plate and the upper surface of the auxiliary ring, so that the timepiece display plate cannot be easily detached.

Further, in the prior-art technique, the length of the columnar protrusions as measured from the upper surface of the outer peripheral portion of the auxiliary ring is small. As a result, the columnar protrusions do not easily undergo elastic deformation, so that the operation of engaging the cutouts with the columnar protrusions to fix the timepiece display plate to the auxiliary ring is rather bothersome to perform.

As described above, the prior-art technique has a problem in that it is rather difficult to easily perform the attachment/detachment of the timepiece display plate, which involves engagement of the cutouts of the timepiece display plate with the columnar protrusions of the auxiliary ring.

To solve the above problem, there are provided, in accordance with the present invention: a module; a panel fixed to the module; a ring member fixed to a peripheral portion of the module, the ring member being provided, at a plurality of positions thereof, with recesses respectively open to an upper surface and an outer peripheral surface of the ring member, with a pair of engagement protrusions forming a gap therebetween and capable of elastic deformation protruding upwardly from the bottom of each recess, with proximal portions thereof being situated below the upper surface; and a timepiece display plate having cutouts at a plurality of peripheral positions thereof, with the cutouts being engaged with the pair of engagement protrusions for the mounting of the timepiece display plate to the ring member, and arranged so as to cover the panel, with the peripheral portions of the cutouts covering the recesses.

When the present invention is applied to analog timepiece, the term module refers to a movement driving a plurality of time indicating hands, and when the present invention is applied to a digital timepiece, the term module refers to an electronic circuit driving a display indicating time, etc. In the present invention, the term panel refers to a solar cell panel, a light emission panel or the like. In the present invention, the pair of engagement protrusions respectively provided at a plurality of positions of the ring member are formed in a columnar configuration; the plan configuration thereof may be any of a substantially circular one, a substantially elliptical one, a substantially oval one, a substantially trapezoidal one, a substantially square one, etc., and the proximal portions of the engagement protrusions may exhibit the same section as that of a portion above the same, or may be formed so as to thicker than the portion above the same and be gradually increased in thickness toward the bottoms of the recesses. Further, in the present invention, the expression: "the proximal portions are situated below the upper surface (of the ring member)" implies that at least the lower portions of the proximal portions are situated below the upper surface of the ring member, and is not restricted to the positioning of the entire proximal portions. Further, when the present invention is applied to an analog timepiece, the term timepiece display plate refers to a transparent dial, and when the present invention is applied to a digital timepiece, it refers to a cover plate (commonly called a panel cover) having a window facing a desired portion of a display indicating time, etc., with the portion thereof other than this window covering the display.

In the present invention, a pair of engagement protrusions protrude from the bottoms of the recesses provided in the ring member, and the proximal portions of the engagement protrusions are situated below the upper surface of the ring member, so that the engagement protrusions easily allow elastic deformation so as to reduce the mutual gap as the length of the engagement protrusions can be increased according to the depth of the recesses. Thus, the cutouts of the timepiece display plate can be easily engaged with the pair of engagement protrusions, so that the timepiece display plate covering the panel fixed to the module can be easily mounted to the ring member. In the state in which the timepiece display plate has been mounted, the peripheral portion of the cutouts covers the recesses of the ring member; the recesses are open in the outer peripheral surface of the ring member. Thus, the tool for detaching the timepiece display plate can be easily inserted into the recesses from the outside of the ring member, whereby it is possible to detach the timepiece display plate engaged with the engagement protrusions of the ring member by prying it off by the tool arranged on the back side of the timepiece display plate.

In a preferred form of the present invention, the proximal portions of the engagement protrusions are formed so as to be gradually increased in thickness as they extend toward the bottoms of the recesses.

In this preferred form of the invention, the bottoms of the recesses and the peripheral surfaces of the proximal portions of the engagement protrusions are continuous with each other while forming an obtuse angle therebetween, or forming no angle, so that the stress in the state in which the engagement protrusions are elastically deformed is not easily concentrated on the proximal portions. As a result, the fear of cracks being formed in the proximal portions of the engagement protrusions by an external force such as vibration applied to the timepiece is reduced, and it is advantageously further possible to reliably maintain the timepiece display plate in the state in which it is mounted to the ring member.

In a preferred form of the present invention, in a section of the engagement protrusions taken along the axial direction, the peripheral surfaces of the proximal portions are formed by arcs extending from the portions of the engagement protrusions above the proximal portions to the bottom surfaces of the recesses to connect them together.

In this preferred form of the invention, the bottoms of the recesses and the peripheral surfaces of the proximal portions of the engagement protrusions are smoothly continuous with each other without forming a corner therebetween. Thus, it has a further advantage in that the fear of cracks being generated in the proximal portions is further reduced as less stress is allowed to be concentrated on the proximal portions.

In a preferred form of the present invention, the engagement protrusions are substantially of a quadratic-prism-like configuration. In this invention, the substantially quadratic-prism-like configuration not only implies that the cross-sectional configuration of the engagement protrusions is rectangular or square, but also a construction in which beads are provided on the side surfaces of the engagement protrusions engaged with the cutouts, or a construction in which the side surfaces protrude outwardly in an arcuate fashion, with the protruding forward end portions being engaged with the cutouts.

In this preferred form, the cross-sectional area of the engagement protrusions is larger as compared with the case in which the engagement protrusions are of a columnar configuration, so that it is possible to enhance the elastic force of the engagement protrusions engaged with the cutouts of the timepiece display plate without involving an increase in the thickness of the engagement protrusions as a whole. Thus, it has a further advantage in that it is possible to mount the timepiece display plate so as to prevent it from being inadvertently detached from the engagement protrusions. Further, due to the increase in the cross-sectional area, as compared with the case in which the engagement protrusions are formed in a thick columnar configuration, there is no special need to deepen the cutouts of the timepiece display plate. As a result, it has a further advantage in that the inner diameter of the panel cover covering the peripheral portion of the timepiece display plate is not reduced, and that there is no need to increase the inner diameter of the case band.

In a preferred form of the present invention, the portions of the recesses are of the same depth.

In this preferred form of the invention, when producing the mold for forming the ring member, the portions of the mold corresponding to the recesses are not formed by protrusions and recesses, so that the production of the mold is easy. Thus, with the reduction in mold cost, it is further advantageous in that the cost of the ring member can be further reduced.

In a preferred form of the present invention, each recess is formed to have a pair of mutually parallel first recessed portions which have groove side surfaces consisting of one side surfaces of the proximal portions situated on the sides opposite to the gap of the pair of engagement protrusions arranged in the recess and whose one ends are open in the outer peripheral surface of the ring member, a second recessed portion which has groove side surfaces consisting of the other side surfaces of the proximal portions facing the gap and whose one end is open in the outer peripheral surface of the ring member and also serves as the lower portion of the gap, and a third recessed portion which extends between the other ends of the pair of first recessed portions and whose central portion in the longitudinal direction is continuous with the other end of the second recessed portion, with the pair of first recessed portions being formed deeper than the second recessed portion.

In this preferred form of the invention, the depth of the first recessed portions whose one ends are open in the outer peripheral surface of the ring member is large, so that it is further advantageous in that, when detaching the timepiece display plate, a tool for the detachment can be more easily arranged through insertion into the back side of the timepiece display plate.

In a preferred form of the present invention, a bead extending parallel to the direction of the center axes of the engagement protrusions is formed on a side surface of each engagement protrusion on the side opposite to the gap, and this bead is engaged with an edge of the cutout.

In this preferred form of the invention, due to the engagement of the bead with the edge of the cutout, there is achieved a further advantage in that the side surfaces of the engagement protrusions are brought into contact with the edge of the cutout more easily and reliably, making it possible to mount the timepiece display plate without involving any rattling.

In a preferred form of the present invention, the panel is a solar cell panel which generates power through photoelectric conversion.

This preferred form of the invention has a further advantage in that the power supplied to the module or the like driven, for example, by electric power, can be generated by a solar cell panel receiving light transmitted through the timepiece display plate.

In a preferred form of the present invention, the panel is a light emitting panel emitting light in a state in which electricity is supplied thereto.

In this preferred form of the invention, the light emitting panel emits light through electricity supply thereto, making it possible to effect backlight illumination on the timepiece display plate, so that it is advantageously further possible to further improve the visibility in the display of time, etc.

In the timepiece of the present invention, it is possible to increase the length of the engagement protrusions of the ring member, and the tool for detaching the timepiece display plate having cutouts engaged with the engagement protrusions can be easily inserted into the back side thereof, so that the engagement of the cutouts with the engagement protrusions and the attachment/detachment of the timepiece display plate involving the releasing of the engagement, can be easily performed.

DETAILED DESCRIPTION OF THE PREFERRED EMBODIMENTS

In the following, the first embodiment of the present invention will be described in detail with reference to FIGS. 1 through 6.

Figure 1:
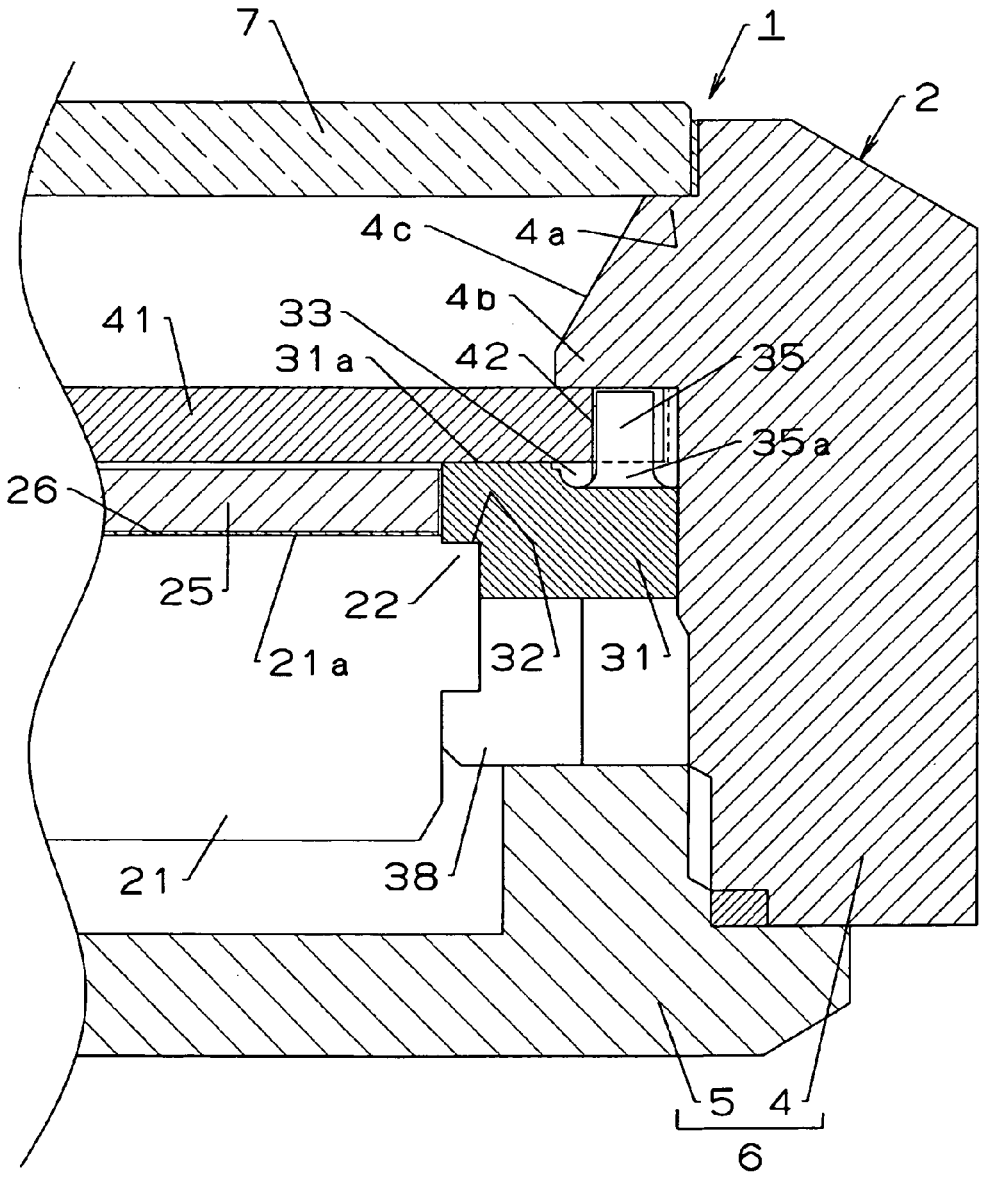
FIG. 1 is a sectional view of a part of a wristwatch according a first embodiment of the present invention.

In FIG. 1, numeral 1 indicates a timepiece such as a portable timepiece, and, more specifically, a wristwatch. The wristwatch 1 is equipped with a timepiece exterior assembly 2, a module such as a movement 21, a panel such as a solar cell panel 25, a ring member 31, and a timepiece display plate such as a dial 41.

The timepiece exterior assembly 2 is equipped with an exterior member 6 of metal or synthetic resin having a case band 4 and a case back 5, and a cover glass 7. The case back 5 is connected to the case band 4 by being thrust into the same. The exterior member 6 may also be a one-piece type construction in which the case band 4 and the case back 5 are formed integrally. The cover glass 7 is attached in a liquid-tight fashion to the inner side of a glass support portion 4*a* formed on the case band 4.

The exterior member 6 has a panel cover 4*b*. While the panel cover 4*b* shown in FIG. 1 is formed integrally with the inner periphery of the case band 4, it may also be a ring-shaped member formed separately from the case band 4. The panel cover 4*b* has a slope 4*c*, and the slope 4*c* is opposed to the back surface of the peripheral portion of the cover glass 7.

The movement 21 is driven by electric power generated by the solar cell panel 25 described below, and is equipped with a secondary cell or a capacitor or the like (not shown) for accumulating the electric power. The movement 21 is circular in plan view. The movement 21 is supported on the inner side of an annular casing ring. The casing ring is incorporated into the timepiece exterior assembly 2 while engaged with the exterior member 6.

Figure 4:
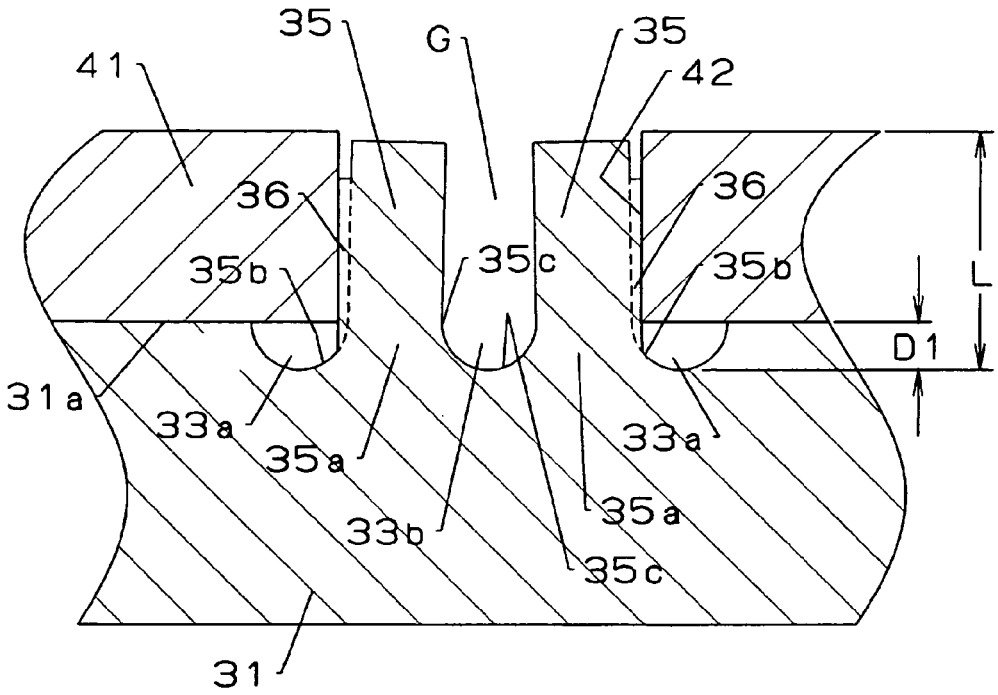
FIG. 4 is a sectional view taken along the line F4-F4 of FIG. 3.

The movement 21 has an engagement portion 22. The engagement portion 22 is provided at the peripheral portion of the movement 21 and closer to the upper surface 21*a* side, and is formed, for example, as an annular protrusion continuous in the peripheral direction of the movement 21. As shown in FIG. 4, the engagement portion 22 is somewhat retracted in the direction of the back side (lower side) of the movement 21 with respect to the upper surface 21*a* of the movement 21.

The solar cell panel 25 is a panel formed by mounting on a substrate (not shown) a solar cell (not shown) as a power generation element generating power through photoelectric conversion. The solar cell may be of a crystalline type or an amorphous type. The diameter of the solar cell panel 25 is somewhat smaller than the diameter of the movement 21; it is fixed to the upper surface 21*a* of the movement 21 by using an adhesive member 26. As the adhesive member 26, a double-faced tape having adhesiveness on both sides can be suitably used.

The ring member 31 is an integral molding of synthetic resin. The ring member 31 is ring-shaped in plan view; its inner diameter is somewhat larger than the diameter of the solar cell panel 25, and its outer diameter is larger than the diameter of the movement 21. The ring member 31 has an engagement groove 32 open in the inner surface and the back surface (lower surface) thereof. The engagement groove 32 is formed in an annular configuration so as to be continuous in the peripheral direction of the ring member 31.

Figure 2:
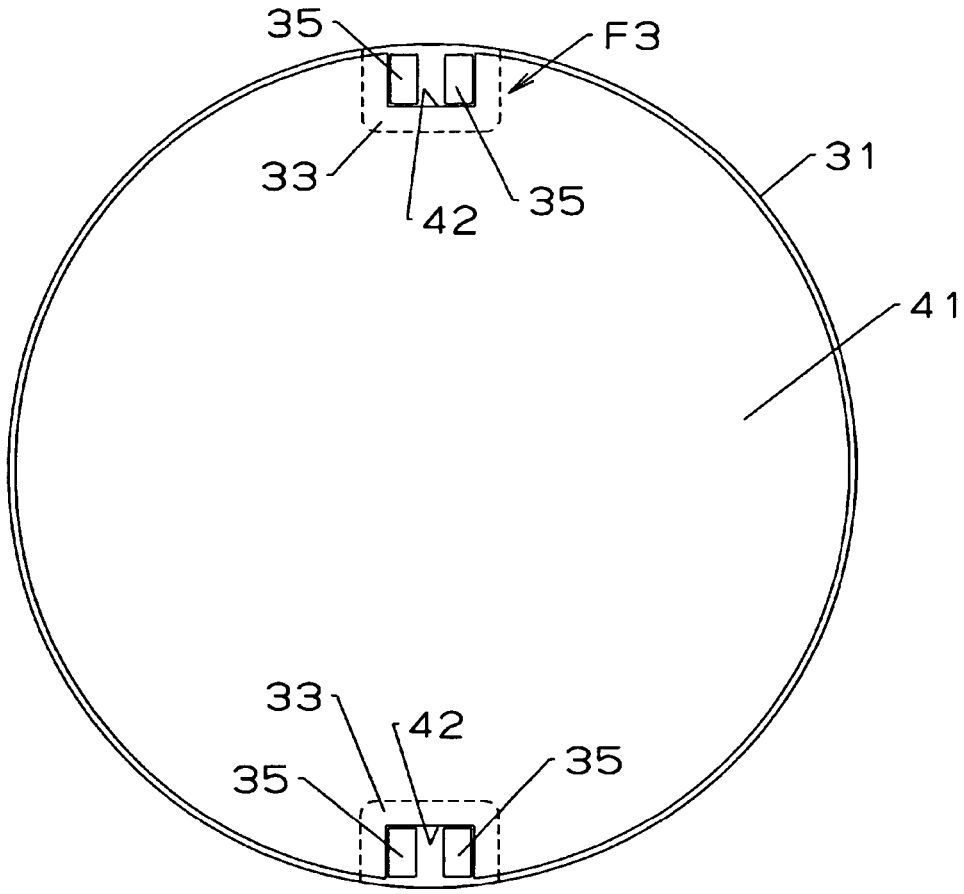
FIG. 2 is a schematic front view of a movement with which the wristwatch of FIG. 1 is equipped, showing it in a state in which a solar cell panel and a timepiece display plate are attached thereto.
Figure 6:
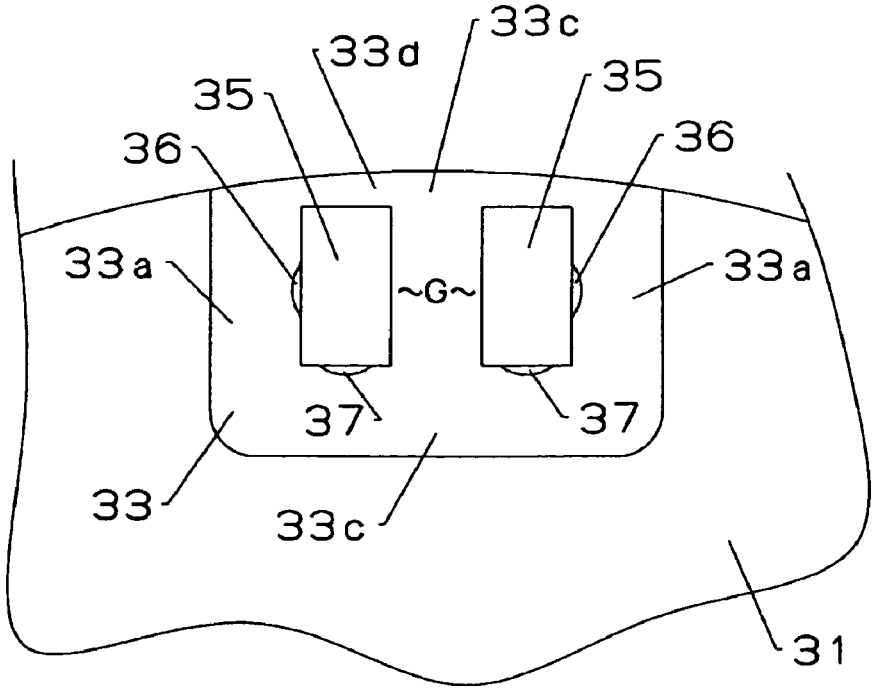
FIG. 6 is an enlarged front view of a recess with which the wristwatch of FIG. 1 is equipped and a pair of engagement protrusions protruding from this recess.

Further, the ring member 31 has, at a plurality of positions, a recess 33 and a pair of engagement protrusions 35, and hook portions 38 (only one of which is shown in FIG. 1) at a plurality of positions on the back surface thereof. As shown in FIG. 2, the recess 33 is provided at two positions of the outer peripheral portion of the ring member 31 spaced apart from each other, for example, by 180 degrees. The recesses 33 are open in an upper surface 31*a* and the outer peripheral surface of the ring member 31; as shown in FIG. 6, each recess is composed of a pair of recessed portions 33*a*, and a second recessed portion 33*b* through a fourth recessed portion 33*d*.

The pair of first recessed portions 33*a* and the second recessed portion 33*b* situated between them are parallel to each other. One end of each of the first recessed portions 33*a* and the second recessed portion 33*b* is open in the outer peripheral surface of the ring member 31. The third recessed portion 33*c* is provided to extend between the other ends of the pair of first recessed portions 33*a*, with the other end of the second recessed portion 33*b* being continuous with the central portion in the longitudinal direction of the third recessed portion 33*c*. The fourth recessed portion 33*d* is provided to extend between one end portions of the pair of first recessed portions 33*a*, and is open in the outer peripheral surface of the ring member 31 over the entire longitudinal portion thereof. One end portion of the second recessed portion 33*b* is continuous with the central portion in the longitudinal direction of the fourth recessed portion 33*d*.

One first recessed portion 33*a* and the second recessed portion 33*b*, and one end portions of the third recessed portion 33*c* and the fourth recessed portion 33*d* extending between them, are continuous with each other in, for example, a rectangular annular configuration. Similarly, the other first recessed portion 33*a* and the second recessed portion 33*b*, and the other end portions of the third recessed portion 33*c* and the fourth recessed portion 33*d* are also continuous with each other in, for example, a rectangular annular configuration.

Figure 5:
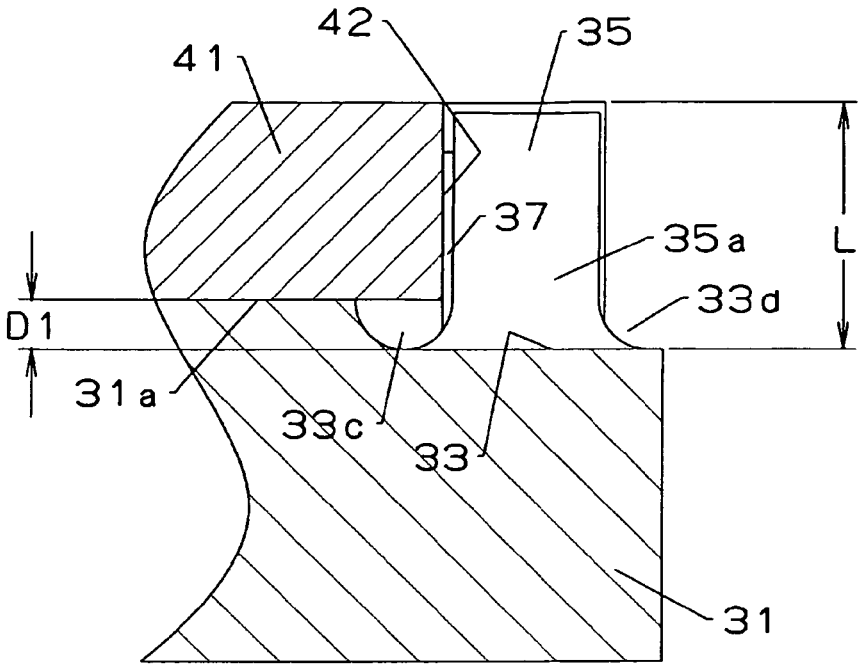
FIG. 5 is a sectional view taken along the line F5-F5 of FIG. 3.

The first recessed portions 33*a* through the fourth recessed portion 33*d* have the same depth D1 (See FIGS. 4 and 5). Since the portions of the recess 33 are thus of the same depth D1, when producing a mold for molding the ring member 31, the portions of the mold corresponding to the recesses 33 are not formed as protrusions and recesses. Thus, the production of the mold is facilitated, and the mold cost is reduced, thereby making it possible to achieve a reduction in the production cost of the ring member 31.

The pair of engagement protrusions 35 are provided in each recess 33, with each of them protruding integrally and upwardly from the bottom of the recess 33. Thus, in a preferred example, proximal portions 35*a* of the engagement protrusions 35 as a whole are situated below the upper surface 31*a* of the ring member 31. As shown in FIG. 4, etc., a gap G is formed between the pair of engagement protrusions 35, and the pair of engagement protrusions 35 are formed so as to be capable of elastic deformation so as to reduce the gap G. In the free state, the width of the gap G is the same as the width of the second recessed portion 33*b*.

Figure 3:
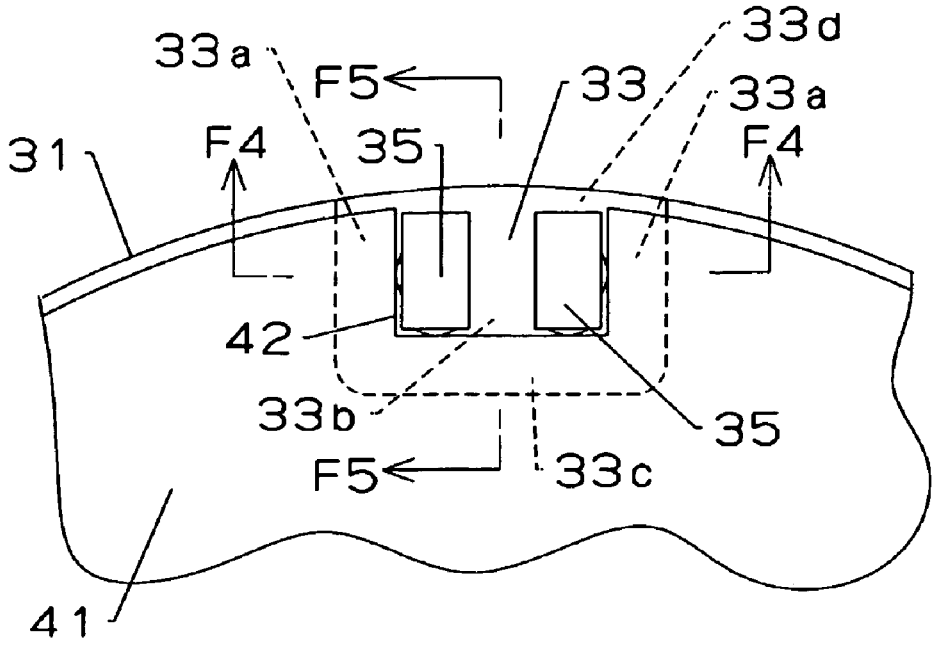
FIG. 3 is an enlarged view of a portion F3 of FIG. 2.

As shown in FIG. 6, etc., each engagement protrusion 35 has a bead 36 on one side surface of the engagement protrusion 35 on the opposite side of the gap G, and a bead 37 on another side surface thereof continuous with the one side surface at right angles and situated on the inner peripheral side of the ring member 31; the engagement protrusions are formed in a quadratic-prism-like configuration. As shown in FIGS. 3 and 6, the engagement protrusions 35 are substantially of a square configuration, and, preferably, substantially of a rectangular configuration in plan view. In this case, the engagement protrusions 35 are provided such that the side surfaces constituting the longer sides thereof extend along the radial direction of the ring member 31. As a result, as compared with the case in which the shorter sides thereof extend in the radial direction of the ring member 31, the engagement protrusions 35 undergo elastic deformation more easily.

As shown in FIG. 6, the beads 36 and 37 are situated, for example, at the central positions in the width direction of the side surfaces on which they are provided and consist of protrusions of an arcuate configuration in plan view. The beads 36 and 37 extend in a direction parallel to the direction in which the center axes (not shown) of the engagement protrusions 35 extend. As shown in FIGS. 4 and 5, the upper ends of the beads 36 and 37 are somewhat below the upper ends of the engagement protrusions 35, and the lower ends of the beads 36 and 37 reach the proximal portions 35*a* of the engagement protrusions 35.

The proximal portions 35*a* of the engagement protrusions 35 are surrounded by the first recessed portions 33*a* through the fourth recessed portion 33*d*, which are annularly continuous with each other as described above. The pair of engagement protrusions 35 forming the gap G may also be formed so as to have side surfaces flash with the outer peripheral surface of the ring member 31; in this case, the fourth recessed portion 33*d* is omitted.

As shown in FIG. 4, in a sectional view taken along the axial direction of the engagement protrusions 35, the peripheral surfaces of the proximal portions 35*a* of the engagement protrusions 35 are formed by arcs connecting the portions above the proximal portions 35*a* and the bottom surface of the recess 33. As a result, the peripheral surfaces of the proximal portions 35*a* are continuous without forming a corner between the portions above the proximal portions and the bottom surface of the recess 33, with the result that the engagement protrusions 35 are formed so as to be gradually increased in thickness toward the bottom of the recess 33. Thus, one side surface of the proximal portion 35*a* of each engagement protrusion 35 situated on the side opposite to the gap G, without facing the gap G, also serves as a groove side surface 35*b* of the first recessed portion 33*a*. Similarly, the other side surface of the proximal portion 35*a* of each engagement protrusion 35 facing the gap G also serves as a groove side surface 35*c* of the second recessed portion 33*b*.

As shown in FIG. 1, the ring member 31 is mounted to the movement 21 by hooking the hook portion 38 thereof on the lower surface of the engagement portion 22 of the movement 21 and by engaging the engagement groove 32 with the upper surface thereof. Through the above-mentioned mounting, the recesses 33 spaced apart from each other by 180 degrees are arranged in the 12 o'clock-6 o'clock direction as shown in FIG. 2, and the upper surface 31*a* of the ring member 31 except for the engagement protrusions 35 is situated somewhat higher than the upper surface of the solar cell panel 25. The arrangement of the pair of recesses 33 is not restricted to the 12 o'clock-6 o'clock direction; they may also be arranged in the 9 o'clock-3 o'clock direction or in some other direction.

The dial 41 is formed as a thin plate of a resin molding of transparent acryl or polycarbonate, and is provided with a scale, numbers, patterns, etc (not shown). The circular dial 41 is of a somewhat smaller diameter than the outer diameter of the ring member 31. The dial 41 has cutouts 42 at a plurality of positions of the peripheral portion thereof, and these cutouts 42 are open to the peripheral surface of the dial 41.

These cutouts 42 are provided in the same number as the plurality of recesses 33 and in conformity with the arrangement of these recesses 33. Thus, as shown in FIG. 2, the two recesses 33 are spaced apart from each other by 180 degrees in the peripheral direction of the dial 41. Each cutout 42 is formed in a size large enough to accommodate the pair of engagement protrusions 35 adjacent to each other while forming the gap G and to cover, as shown in FIG. 3, the pair of first recessed portions 33*a* and the third recessed portion 33*c*.

The dial 41 is mounted to the ring member 31, with each cutout 42 being engaged with the pair of engagement protrusions 35 forming the gap G. This mounting can be carried out by pressing the dial 41 downwardly from above the movement 21, with the pairs of engagement protrusions 35 forming the gaps G and the cutouts 42 of the dial 41 being held in position with respect to the movement 21 to which the solar cell panel 25 and the ring member 31 are attached.

As a result, the engagement protrusions 35 adjacent to each other while forming the gap G are lightly forced into each cutout 42 while undergoing elastic deformation so as to reduce the gap G, and, as shown in FIG. 3, etc., the beads 36 are engaged with the cutouts 42, that is, brought into intimate contact with the mutually parallel edges of the cutouts 42, and, at the same time, the beads 37 are engaged with the cutout 42, that is, brought into intimate contact with the depth edges of the cutouts 42 extending between the mutually parallel edges. Further, while maintaining this intimate contact state, the back surface of the dial 41 abuts the upper surface 31*a* of the ring member 31, whereby the pressing operation is prevented, thus completing the mounting of the dial 41.

Due to the provision of the beads 36 and 37 on each engagement protrusion 35, it is possible to engage the side surface of the engagement protrusion 35 easily and reliably with the cutout 42, making it possible to mount the dial 41 without involving any rattling. Further, the bead 36 can be provided at an arbitrary position within the width of the side surface of each engagement protrusion 35, so that it is possible to attain a high degree of freedom in terms of design for the engagement position of the dial 41 with respect to the cutouts 42 due to the engagement protrusions 35.

The proximal portions 35*a* of the engagement protrusions 35 are formed thicker than the portions thereof higher than themselves, and these proximal portions 35*a* are situated below the upper surface 31*a* of the ring member 31. Thus, in the mounting of the dial 41 through the above operation, there is no fear of the proximal portions 35*a* preventing the back surface of the dial 41 from abutting the upper surface 31*a* of the ring member 31.

The dial 41 thus mounted is opposed to the back surface of the cover glass 7 as shown in FIG. 1, and the peripheral portion of the dial 41 is covered with the panel cover 4*b*. Since the dial 41 is transparent, as natural light or artificial light transmitted through the cover glass 7 and the dial 41 enters the solar cell panel 25, the solar cell of this solar cell panel 25 undergoes photoelectric conversion and generates power. Thus, in the wristwatch 1, the power thus generated is accumulated in a secondary cell or a capacitor, and it is possible to drive the movement 21 with that electric power.

In the wristwatch 1 constructed as described above, the pair of engagement protrusions 35 protrude upwardly from the bottom of each recess 33 provided in the ring member 31 as described above, and the proximal portion 35*a* of each engagement protrusion 35 is situated below the upper surface 31*a* of the ring member 31. Thus, the total length L of each engagement protrusion 35 (See FIGS. 4 and 5) increases according to the depth D1 of the recesses 33, and the engagement protrusions 35 can easily undergo elastic deformation so as to reduce the gap G.

As a result, the pair of engagement protrusions 35 can be easily engaged with each cutout 42 of the dial 41. As a result, the dial 41 covering the solar cell panel 25 fixed to the movement 21 can be easily mounted to the ring member 31.

As described above, the engagement protrusions 35 to which the dial 41 is mounted are substantially of a quadratic-prism-like configuration, so that the cross-sectional area thereof is larger as compared with the case in which the engagement protrusions are of a columnar configuration. Thus, the elastic force with which the dial 41 is engaged with the cutouts 42 is enhanced without enlarging the thickness of the engagement protrusions 35 as a whole, so that it is possible to mount the dial 41 without allowing it from being inadvertently detached from the engagement protrusions 35.

Nevertheless, since the entire total length L of the engagement protrusions 35 is large as described above, so that it is possible to avoid applying to the dial 41 such an excessively large elastic force as will cause undulating deformation of the dial 41. As a result, it is possible to prevent the generation of the problem when the transparent dial 41 is undulated; that is, it is possible to avoid a state in which light reflection differs at different portions of the dial 41 to make easily visible the undulated state of the dial 41, thus impairing the outward appearance of the wristwatch 1.

Further, to increase the cross-sectional area of the engagement protrusions 35, there is no need to especially deepen the cutouts 42 of the dial 41 as compared with the case in which the engagement protrusions 35 are formed in a thick columnar configuration. As a result, the inner diameter of the panel cover 4*b* covering the peripheral portion of the dial 41 is not reduced, and, Consequently, there is no need to increase the case band inner diameter, so that the wristwatch 1 is not increased in size. Further, as described above, the inner diameter of the panel cover 4*b* is not reduced, so that there is no fear of the actual display area of the dial 41 being reduced.

As described above, the proximal portions 35*a* of the engagement protrusions 35 engaged with the cutouts 42 of the dial 41 while maintaining the elastically deformed state are formed so as to be gradually increased in thicknesses toward the bottoms of the recesses 33. Moreover, the bottoms of the recesses 33 and the peripheral surfaces of the proximal portions 35*a* are continuous with each other without forming any corner therebetween, so that stress is not easily concentrated on the proximal portions 35*a*. As a result, it is possible to reduce the fear of cracks being generated in the proximal portions 35*a* of the engagement protrusions 35 due to an external force such as vibration applied to the wristwatch 1. Similarly, the portions of the engagement protrusions 35 above the proximal portions 35*a* and the peripheral surfaces of the proximal portions 35*a* are also continuous with each other without generating any corner therebetween, so that, in this respect also, stress is not easily concentrated on the proximal portions 35*a*. Thus, it is possible to reliably maintain the state in which the dial 41 is mounted to the ring member 31.

The peripheral portion of the cutouts 42 of the dial 41 mounted to the ring member 31 is in contact with the upper surface 31*a* of the ring member 31 and covers the recesses 33; the recesses 33 are open in the outer peripheral surface of the ring member 31.

Thus, when it is necessary to detach the dial 41 for maintenance, it is possible to easily insert a tool such as tweezers (not shown) for detaching the dial 41 into the recessed portions 33*a* of the recesses 33 from the outside of the ring member 31. As a result, it is possible to arrange the tool on the back side of the dial 41, and then detach the dial 41, engaged with the engagement protrusions 35 of the ring member 31, by prying it off by the tool. In addition, it is possible to perform this prying-off operation at a position in the vicinity of the cutouts 42 engaged with the engagement protrusions 35. Further, as described above, the total length L of the engagement protrusions 35 is large, and they can easily undergo elastic deformation, so that no excessive operational force is required for the prying-off operation. Thus, the dial 41 can be detached relatively easily.

Figure 7:
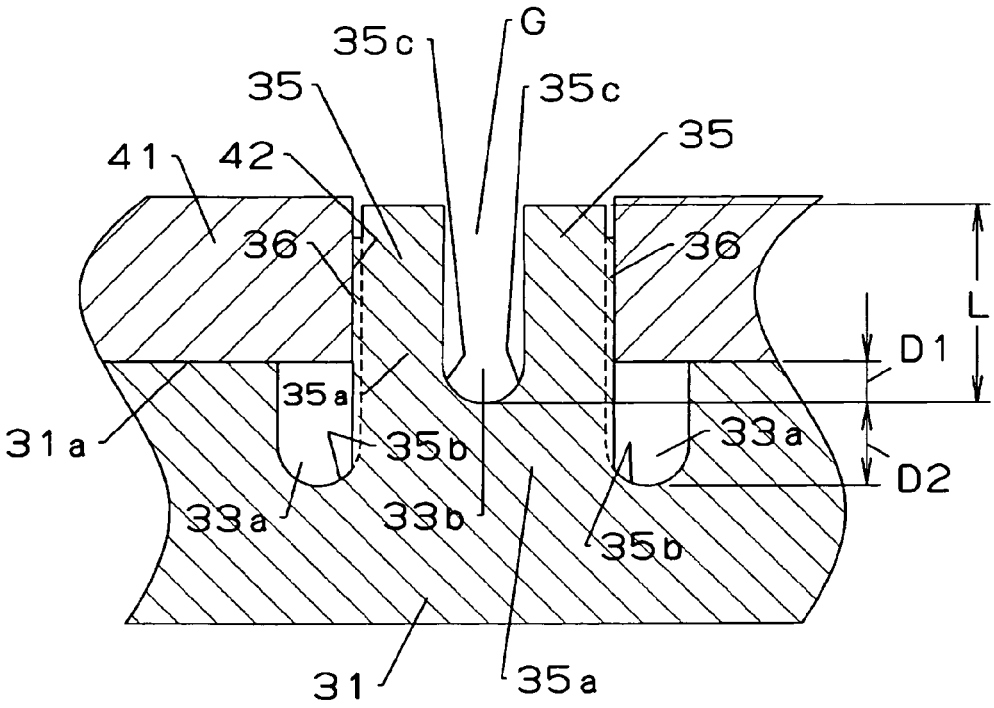
FIG. 7 is a sectional view, corresponding to FIG. 4, showing a part of a wristwatch according to a second embodiment of the present invention.

FIG. 7 shows the second embodiment of the present invention. Except for the matter described below, the wristwatch of the second embodiment is the same as that of the first embodiment inclusive of the construction not shown in FIG. 7. Thus, the components that are the same as those of the first embodiment are indicated by the same reference numerals, and a description thereof will be omitted.

In the second embodiment, the depth D2 of the pair of first recessed portions 33*a* is larger than the depth D1 of the second recessed portion 33*b*.

Apart from the above feature, it is of the same construction as the first embodiment. Thus, in the second embodiment, the same effect as that of the first embodiment is attained for the same reason as stated with reference to the first embodiment, making it possible to solve the problem to be solved by the present invention. Thus, it is possible to provide a wristwatch in which the engagement of the cutouts 42 of the dial 41 with the engagement protrusions 35 of the ring member 31 and the attachment/detachment of the dial 41 involving the releasing of the engagement can be easily performed.

Further, in the second embodiment, since the depth D2 of the first recessed portions 33*a* is large, it is possible to insert the tool for detaching the dial 41 more easily into the first recessed portions 33*a* when detaching the dial 41.

Figure 8:
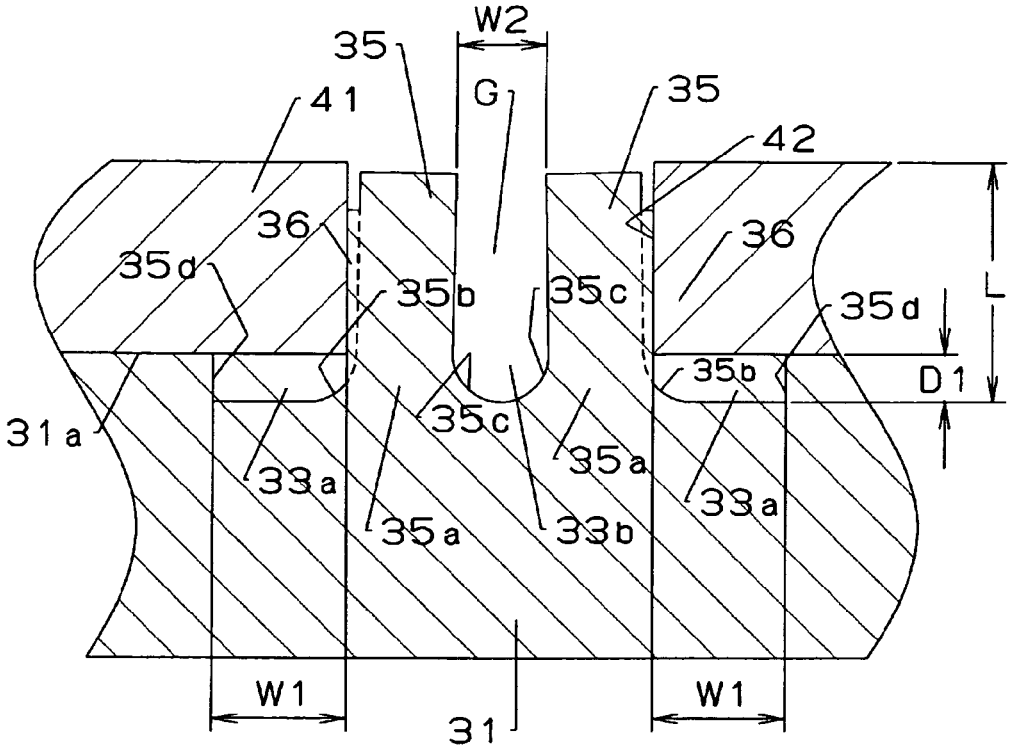
FIG. 8 is a sectional view, corresponding to FIG. 4, showing a part of a wristwatch according to a third embodiment of the present invention.

FIG. 8 shows the third embodiment of the present invention. Except for the matter described below, the wristwatch of the third embodiment is of the same construction as that of the first embodiment inclusive of the construction not shown in FIG. 8. Thus, the components that are the same as those of the first embodiment are indicated by the same reference numerals, and a description thereof will be omitted.

In the third embodiment, the width W1 of the pair of first recessed portions 33*a* is larger than the width W2 of the second recessed portion 33*b*. At the same time, the groove side surfaces 35*d* of the first recessed portions 33*a* opposed to the proximal portions 35*a* of the engagement protrusions 35 are formed to be substantially at right angles with respect to the bottom surfaces of the first recessed portions 33*a*. The groove side surfaces 35*d* may also formed as curved surfaces continuous with the bottom surfaces of the first recessed portions 33*a* without forming any corner therebetween.

Apart from the matter described above, it is of the same construction as the first embodiment. Thus, in the third embodiment, the same effect as that of the first embodiment is attained for the same reason as stated with reference to the first embodiment, making it possible to solve the problem to be solved by the present invention. Thus, it is possible to provide a wristwatch in which the engagement of the cutouts 42 of the dial 41 with the engagement protrusions 35 of the ring member 31 and the attachment/detachment of the dial 41 involving the releasing of the engagement can be easily performed.

Further, in the third embodiment, since the width W1 of the first recessed portions 33*a* is large, it is possible to use a tool of a large width as the tool for detaching the dial 41. Thus, when detaching the dial 41, it is possible to pry off the dial 41 while suppressing concentration of the prying force at one portion on the back surface of the dial 41.

Figure 9:
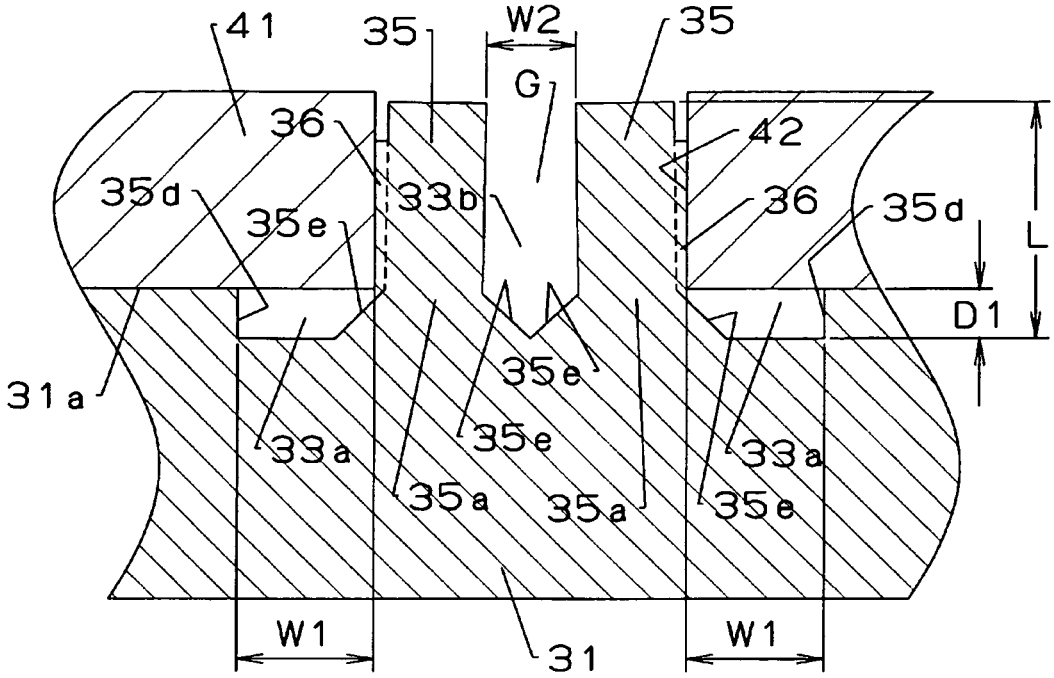
FIG. 9 is a sectional view, corresponding to FIG. 4, showing a part of a wristwatch according to a fourth embodiment of the present invention.

FIG. 9 shows the fourth embodiment of the present invention. Except for the matter described below, the wristwatch of the fourth embodiment is of the same construction as that of the third embodiment inclusive of the construction not shown in FIG. 9. Thus, the components that are the same as those of the third embodiment are indicated by the same reference numerals, and a description thereof will be omitted.

In the fourth embodiment, in a section taken along the axial direction of the engagement protrusions 35, the peripheral surfaces of the proximal portions 35*a* of the pair of engagement protrusions 35 adjacent to each other while forming the gap G, are formed by slopes 35*e* connecting the portions of the engagement protrusions 35 above the proximal portions 35*a* with the bottom surface of the recess 33. As a result, the bottom surface of the recess 33 and the peripheral surfaces of the proximal portions 35*a* are continuous with each other while making an obtuse angle, and, at the same time, the peripheral surfaces of the proximal portions 35*a* and the portions of the engagement protrusions 35 above the proximal portions 35*a* are continuous with each other while making an obtuse angle; however, this embodiment is the same as the third embodiment in that the proximal portions 35*a* are formed to be gradually increased in thickness toward the bottom of the recess 33.

Apart from the matter described above, it is of the same construction as the third embodiment. Thus, in the fourth embodiment, the same effect as that of the third embodiment is attained for the same reason as stated with reference to the third embodiment, making it possible to solve the problem to be solved by the present invention. Thus, it is possible to provide a wristwatch in which the engagement of the cutouts 42 of the dial 41 with the engagement protrusions 35 of the ring member 31 and the attachment/detachment of the dial 41 involving the releasing of the engagement can be easily performed.

The present invention is not restricted to the above embodiments. For example, in the embodiments, it is possible to use a light emitting panel instead of the solar cell panel. As the light emitting panel, a panel consisting, for example, of an electroluminescence can be suitably used, and this light emitting panel effects light emission by electric power supplied from a secondary cell or the like contained in the timepiece exterior assembly. In the case where the invention is thus carried out, the light emitting panel emits light through electricity supply thereto, and it is possible to effect backlight illumination on the timepiece display plate by this light emitting panel, so that it is possible to achieve a further improvement in terms of visibility in the display of time, etc. Further, apart from a wristwatch, the present invention is also applicable to a pocket watch.

What is claimed is:

1. A timepiece comprising:

a module;

a panel fixed to the module;

a ring member fixed to a peripheral portion of the module, the ring member being provided, at a plurality of positions thereof, with recesses respectively open to an upper surface and an outer peripheral surface of the ring member, with a pair of engagement protrusions forming a gap therebetween and capable of elastic deformation protruding upwardly from the bottom of each recess, with proximal portions thereof being situated below the upper surface; and a timepiece display plate having cutouts at a plurality of peripheral positions thereof, with the cutouts being engaged with the pair of engagement protrusions for the mounting of the timepiece display plate to the ring member, and arranged so as to cover the panel, with the peripheral portions of the cutouts covering the recesses.

2. A timepiece according to claim 1, wherein the proximal portions of the engagement protrusions are formed so as to be gradually increased in thickness as they extend toward the bottoms of the recesses.

3. A timepiece according to claim 2, wherein, in a section of the engagement protrusions taken along the axial direction, the peripheral surfaces of the proximal portions are formed by arcs extending from the portions of the engagement protrusions above the proximal portions to the bottom surfaces of the recesses to connect them together.

4. A timepiece according to claim 1, wherein the engagement protrusions are substantially of a quadratic-prism-like configuration.

5. A timepiece according to claim 1, wherein the portions of the recesses are of the same depth.

6. A timepiece according to claim 4, wherein each recess is formed to have a pair of mutually parallel first recessed portions which have groove side surfaces consisting of one side surfaces of the proximal portions situated on the sides opposite to the gap of the pair of engagement protrusions arranged in the recess and whose one ends are open in the outer peripheral surface of the ring member, a second recessed portion which has groove side surfaces consisting of the other side surfaces of the proximal portions facing the gap and whose one end is open in the outer peripheral surface of the ring member and also serves as the lower portion of the gap, and a third recessed portion which extends between the other ends of the pair of first recessed portions and whose central portion in the longitudinal direction is continuous with the other end of the second recessed portion, with the pair of first recessed portions being formed deeper than the second recessed portion.

7. A timepiece according to claim 4, wherein a bead extending parallel to the direction in which the center axes of the engagement protrusions extend is formed on a side surface of each engagement protrusion on the side opposite to the gap, and this bead is engaged with an edge of the cutout.

8. A timepiece according to claim 1, wherein the panel is a solar cell panel which generates power through photoelectric conversion.

9. A timepiece according to claim 1, wherein the panel is a light emitting panel emitting light in a state in which electricity is supplied thereto.

* * * * *